US010192499B2

(12) United States Patent
Lu

(10) Patent No.: US 10,192,499 B2
(45) Date of Patent: Jan. 29, 2019

(54) DRIVING DEVICE FOR LIQUID CRYSTAL PANEL AND DRIVING METHOD FOR THE SAME FOR DETERMINING IF AMPLIFYING ORIGINAL DATA VOLTAGES IN A SCANNING DIRECTION

(71) Applicant: Wuhan China Star Optoelectronics Technology Co., Ltd., Wuhan, Hubei (CN)

(72) Inventor: Yucheng Lu, Guangdong (CN)

(73) Assignee: Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 215 days.

(21) Appl. No.: 15/328,456

(22) PCT Filed: Dec. 30, 2016

(86) PCT No.: PCT/CN2016/113743
§ 371 (c)(1),
(2) Date: Jan. 23, 2017

(87) PCT Pub. No.: WO2018/120125
PCT Pub. Date: Jul. 5, 2018

(65) Prior Publication Data

US 2018/0293948 A1 Oct. 11, 2018

(30) Foreign Application Priority Data

Dec. 28, 2016 (CN) ..... 2016 1 1238873

(51) Int. Cl.
*G09G 3/36* (2006.01)

(52) U.S. Cl.
CPC ..... *G09G 3/3614* (2013.01); *G09G 3/3677* (2013.01); *G09G 3/3688* (2013.01);
(Continued)

(58) Field of Classification Search
CPC .. G09G 3/3614; G09G 3/3688; G09G 3/3625; G09G 3/3677; G09G 3/3611;
(Continued)

(56) References Cited

U.S. PATENT DOCUMENTS 6,661,402 B1 * 12/2003 Nitta ..... G09G 3/2011 345/100
7,046,223 B2 * 5/2006 Hashimoto ..... G09G 3/3611 345/211

(Continued)

*Primary Examiner* — Darlene M Ritchie
(74) *Attorney, Agent, or Firm* — Andrew C. Cheng

(57) ABSTRACT

A driving device for liquid crystal panel comprising: a scanning driver for applying a scanning voltage to pixels arranged as a matrix row by row; and a data driver for receiving an image data and a polarity inversion signal, obtaining original data voltages according to the image data, determining if amplifying the original data voltages along a scanning direction according to the polarity inversion signal, and providing the original data voltages or data voltage after being amplified to pixels. A driving method is also disclosed. When polarity inversion signal is inverted to a positive polarity from a negative polarity, the data voltages applied on the data line are gradually increased along a scanning direction. Accordingly, when the polarity inversion signal is inverted to a negative polarity from a positive polarity, the pixel which leaks current seriously is charged with a larger amount of charges, uneven display brightness is obviously decreased.

5 Claims, 2 Drawing Sheets

(52) U.S. Cl.
CPC ... *G09G 3/3655* (2013.01); *G09G 2310/0291* (2013.01); *G09G 2320/0214* (2013.01); *G09G 2320/0233* (2013.01)

(58) Field of Classification Search
CPC ..... G09G 3/3696; G09G 3/36; G09G 3/3685; G09G 2320/0233; G09G 2320/0214; G09G 2320/0247; G09G 2320/0219; G09G 2320/0209; G09G 2310/0291; G09G 2310/0264; G09G 2310/0278; G09G 2310/027
See application file for complete search history.

(56) References Cited

U.S. PATENT DOCUMENTS

| | | | | |
|---|---|---|---|---|
| 2002/0044126 | A1* | 4/2002 | Aoki | G09G 3/2011 345/96 |
| 2006/0125748 | A1* | 6/2006 | Yang | G09G 3/3648 345/88 |
| 2007/0171163 | A1* | 7/2007 | Miyata | G09G 3/3614 345/87 |
| 2009/0267884 | A1* | 10/2009 | Takahashi | G09G 3/3648 345/96 |
| 2011/0242140 | A1* | 10/2011 | Lee | G09G 3/3648 345/690 |
| 2017/0287420 | A1* | 10/2017 | Noguchi | G09G 3/3614 |

* cited by examiner

DRIVING DEVICE FOR LIQUID CRYSTAL PANEL AND DRIVING METHOD FOR THE SAME FOR DETERMINING IF AMPLIFYING ORIGINAL DATA VOLTAGES IN A SCANNING DIRECTION

BACKGROUND OF THE INVENTION

1. Field of the Invention

The present invention relates to a display technology field, and more particularly to a driving device for liquid crystal panel and a driving method for the same.

2. Description of Related Art

Along with the development of optoelectronic and semiconductor technology, the flat panel display is vigorously developed. In many flat panel displays, the liquid crystal display (LCD) has been applied in many aspects of life because of many superior characteristics of high space utilization efficiency, low power consumption, no radiation and low electromagnetic interference.

A liquid crystal display is generally formed by a liquid crystal panel, a backlight module, and other necessary components. The liquid crystal panel includes multiple pixels arranged as a matrix. Each pixel includes a thin-film transistor (TFT) and a liquid crystal capacitor (if necessary, may include a storage capacitor) connected to the TFT. Through the switching control of the TFT, the liquid crystal capacitor is charged with a data voltage in order to realize a display of different images.

Because the liquid crystal can become easily polarized under a prolonged driving by an electric field in a fixed, same direction, eventually the rotation capability of the liquid crystal is compromised. As a result, polarity inversion is required for the data voltage charged to the liquid crystal capacitor in order to prevent the unwanted polarization of the liquid crystal. However, when the data voltage is inverted from a positive polarity to a negative polarity, a voltage difference between a source electrode and a gate electrode of a TFT is decreased such that a leakage current of the TFT is increased. This leads to electrical charges in a liquid crystal capacitor discharging through the data line, and the brightness of the liquid crystal display is dims accordingly. In addition, the scanning of the liquid crystal panel is generally carried out in a row-by-row fashion so that the time period of current leakage is gradually increased along the scanning direction, making the brightness gradually dimmed. As a result, the brightness of a displayed image on the liquid crystal panel becomes uneven.

SUMMARY OF THE INVENTION

In order to solve the problem existed in the conventional art, the purpose of the present invention is to provide a driving device for liquid crystal panel, including a scanning driver for applying a scanning voltage to pixels arranged as a matrix in a liquid crystal panel row by row; and a data driver for receiving an image data and a polarity inversion signal, obtaining original data voltages for providing to pixels in each column according to the image data, determining that if amplifying the original data voltages for providing to the pixels in each column along a scanning direction according to the polarity inversion signal, and providing the original data voltages or data voltage after being amplified to the pixels in each column.

Furthermore, the data driver comprises: a receiving module for receiving the image data and the polarity inversion signal; an original data voltage generation module for generating the original data voltages for providing to the pixels in each column according to the image data; a gain module for determining that if amplifying the original data voltages for providing to the pixels in each column along the scanning direction according to the polarity inversion signal; and an output module for providing the original data voltages or data voltages after being amplified to the pixels in each column.

Furthermore, if the polarity inversion signal is inverted to a positive polarity from a negative polarity, the gain module is determined to amplify the original data voltages for providing to the pixels in each column along the scanning direction.

Furthermore, the gain module further utilizes a following formula 1 to amplify the original data voltages for providing to the pixels in each column, $$V_O=V_i*(Y*U+X)^{pn}; \quad \text{[formula 1]}$$

wherein, Vi represents an original data voltage, Vo represents a data voltage after being amplified, $(Y*U+X)^{pn}$ represents an amplification coefficient, which is gradually increased along the scanning direction; U, X and n are reference coefficients, and each is a fixed value; Y represents a regulation coefficient;

wherein, when the polarity inversion signal is inverted to a positive polarity from a negative polarity, the gain module set p as 1; if the polarity inversion signal is inverted to a negative polarity from a positive polarity, the gain module set p as 0.

Furthermore, the pixels arranged a matrix can be divided into multiple pixel groups, each pixel group includes at least one row of pixels, group numbers of the multiple pixel groups are gradually increased along the scanning direction, and Y represents the group number of each pixel group.

Another purpose of the present invention provides a driving method for liquid crystal panel, comprising: applying a scanning voltage to pixels arranged as a matrix in a liquid crystal panel row by row; receiving an image data and a polarity inversion signal, and obtaining original data voltages for providing to pixels in each column according to the image data; determining that if amplifying the original data voltages for providing to the pixels in each column along a scanning direction according to the polarity inversion signal; and providing the original data voltages or data voltage after being amplified to the pixels in each column.

Furthermore, if the polarity inversion signal is inverted to a positive polarity from a negative polarity, determining to amplify the original data voltages for providing to the pixels in each column along the scanning direction. Furthermore, utilizing a following formula 1 to amplify the original data voltages for providing to the pixels in each column, $$V_O=V_i*(Y*U+X)^{pn}; \quad \text{[formula 1]}$$

wherein, Vi represents an original data voltage, Vo represents a data voltage after being amplified, $(Y*U+X)^{pn}$ represents an amplification coefficient, which is gradually increased along the scanning direction; U, X and n are reference coefficients, and each is a fixed value; Y represents a regulation coefficient.

Furthermore, when the polarity inversion signal is inverted to a positive polarity from a negative polarity, p=1; if the polarity inversion signal is inverted to a negative polarity from a positive polarity, p=0.

Furthermore, the pixels arranged the matrix is divided into multiple pixel groups, group numbers of the multiple pixel groups are gradually increased along the scanning direction, and Y represents the group number of each pixel group.

The beneficial effect of the present invention: in the present invention, when the polarity inversion signal is inverted to a positive polarity from a negative polarity, the data voltages applied on the data line are gradually increased along a scanning direction. Accordingly, when the polarity inversion signal is inverted to a negative polarity from a positive polarity, because the pixel PX which leaks current seriously is charged with a larger amount of charges previously so that the phenomenon of uneven display brightness of the liquid crystal panel can be obviously decreased.

BRIEF DESCRIPTION OF THE DRAWINGS

Through following to combine figures to describe in detail, the above, the other purposes, the features and benefits of the exemplary embodiment of the present disclosure will become clearer, in the figures.

DETAILED DESCRIPTION OF THE PREFERRED EMBODIMENT

The following content combines with the drawings and the embodiment for describing the present invention in detail. However, many other forms can be used to implement the present invention. Besides, the present invention should not be interpreted to be limit in the specific embodiment described here. On the contrary, the embodiments provided here are used for explaining the operation principle and practical application such that person skilled in the art can under various embodiments of the present invention and various modification suitable for specific applications.

Figure 1:
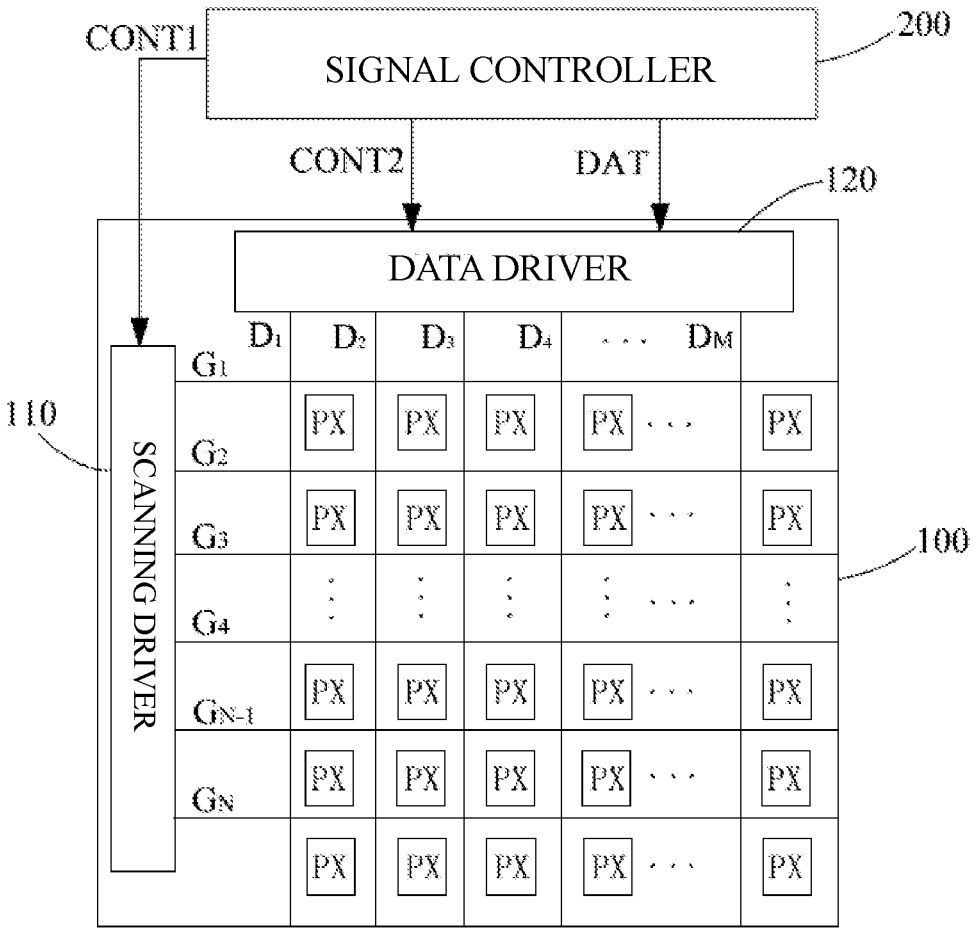
FIG. 1 is an architecture diagram of a display device according to an embodiment of the present invention.

FIG. 1 is an architecture diagram of a display device according to an embodiment of the present invention.

With reference to FIG. 1, the display device according to an embodiment of the present invention includes: a display panel component 100 and a signal controller 200.

The display panel component 100 includes: multiple pixels PX arranged as a matrix, N scanning lines $G_1$ to $G_N$, M data lines $D_1$ to $D_M$, a scanning driver 110, and a data driver 120.

Each pixel PX is connected to a corresponding scanning line Gi and a corresponding data line Dj, wherein, $1 \le i \le N$, $1 \le j \le M$. Each pixel PX can include: a switching device (not shown) connected to a corresponding scanning line Gi and a corresponding data line Dj, a liquid crystal capacitor (not shown) connected to the switching device. In the present embodiment, the switching device is preferably a thin-film transistor, but the present invention is not limited. If necessary, a storage capacitor can be provided to be in parallel with the liquid crystal capacitor.

The scanning driver 110 is connected to scanning lines $G_1$ to $G_N$, and applying a scanning voltage to the scanning lines $G_1$ to $G_N$ row by row. The scanning voltage is a combination of a high voltage level signal and a low voltage level signal.

The data driver 120 is connected to the data lines $D_1$ to $D_M$, and applying data voltages to the data lines $D_1$ to $D_M$. The specific applying method is illustrated as following.

In the present embodiment, the scanning driver 110 and the data driver 120 are integrated to be included in the liquid crystal component 100. Alternatively, the scanning driver 110 and the data driver 120 can be installed on the flexible printed film (not shown), then, attached on the liquid crystal component 100 (at this time, the liquid crystal panel component 100 does not includes the scanning driver 110 and the data driver 120).

The signal controller 200 controls the operation of the scanning driver 110 and the data driver 120.

The signal controller 200 can generate a scanning control signal CONT1, a data control signal CONT2 and an image data DAT. The signal controller 200 transmits the scanning control signal CONT1 to the scanning driver 110, and transmits the data control signal CONT2 and the image data DAT to the data driver 120. In the present embodiment, the data control signal CONT2 includes a polarity inversion signal for inverting a polarity of the data voltage providing to the data line $D_j$.

The data driver 120 responses to the data control signal CONT2 and the image data DAT to generate data voltages and applying the data voltages to the data lines $D_1$ to $D_M$.

The scanning driver 110 responses to the scanning control signal CONT1 and applying a scanning voltage having high voltage level signal to the scanning lines $G_1$ to $G_N$ in order to turn on the switching devices connected to the scanning lines $G_1$ to $G_N$ row by row. Then, the data voltages applied to the data lines $D_1$ to $D_M$ are transmitted to the pixels PX through the switching devices being turned on.

As described in the background technology, when the data voltages applied to data lines $D_1$ to $D_M$ are inverted to a negative polarity from a positive polarity, a voltage difference between the source electrode and a gate electrode of the switching device is reduced so that a leakage current of the switching device is increased. Accordingly, charges of the liquid crystal capacitor are discharged through a data line $D_j$ which is connected to and corresponding to the liquid crystal capacitor so that the display brightness is decreased. Besides, the current leakage time is gradually increased along a scanning direction such that the display brightness is gradually decreased, and finally, the display brightness of the liquid crystal panel is uneven.

In order to solve the above problem, in the present embodiment, when a polarity inversion signal is inverted to a positive polarity from a negative polarity, data voltages applied on the data lines $D_1$ to $D_M$ are gradually increased along the scanning direction. By this way, when the polarity inversion signal is inverted to a negative polarity from a positive polarity, because the pixel PX which leaks current seriously is charged with a larger amount of charges previously so that the phenomenon of uneven display brightness of the liquid crystal panel can be obviously decreased. The following content will illustrate in detail.

Figure 2:
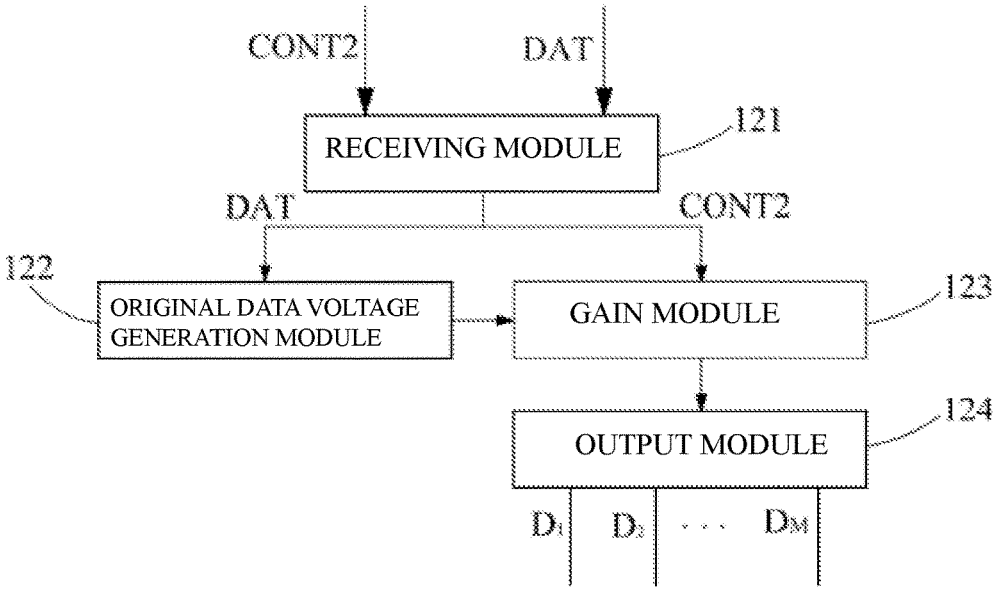
FIG. 2 is a block diagram of a data driver according to an embodiment of the present invention.

FIG. 2 is a block diagram of a data driver according to an embodiment of the present invention.

With reference to FIG. 2, the data driver 120 according to an embodiment of the present invention includes: a receiving module 121, an original data voltage generation module 122, a gain module 123 and an output module 124. According to another embodiment of the present invention, the data driver 120 can include other and/or different modules. Similarly, the functions of the above modules can be integrated into a single component.

The receiving module 121 is used for receiving an image data DAT and a polarity inversion signal (included in the data control signal CONT2). The signal controller 200 transmits the data control signal CONT2 and the image data DAT to the receiving module 121 of the data driver 120, and the receiving module 121 receives the data control signal CONT2 and the image data DAT, transmitting the received image data DAT to the original data voltage generation module 122, and transmitting the data control signal CONT2 to the gain module 123.

The original data voltage generation module 122 receives the image data DAT. The original data voltage generation module 122 selects a grayscale voltage corresponding to the image data DAT from multiple grayscale voltages provided by a grayscale voltage generation device (not shown) according to the image data DAT to convert the image data DAT to an original data voltage provided to the data line Dj (that is, pixel PX in each column). The original data voltage generation module 122 transmits the original data voltage to the gain module 123.

The gain module 123 receives the data control signal CONT2 and the original data voltage. The gain module 123 determines that if amplifying the original data voltage along the scanning direction according to the polarity inversion signal in the data control signal CONT2.

If the polarity inversion signal is inverted to a positive polarity from a negative polarity, the gain module 123 is determined to amplify the original data voltage along the scanning direction, and the data voltage being amplified is transmitted to the output module 124. If the polarity inversion signal is inverted to a negative polarity from a positive polarity, the gain module 123 is determined not to amplify the original data voltage, and transmit the original data voltage to the output module 124.

Preferably, the gain module 123 utilizes a following formula 1 to amplify the original data voltage.

$$V_O = V_i * (Y*U+X)^{pn}; \quad \text{[formula 1]}$$

Wherein, Vi represents an original data voltage, Vo represents a data voltage after being amplified, $(Y*U+X)^{pn}$ represents an amplification coefficient, which is gradually increased along a scanning direction; U, X and n are reference coefficients, and each is a fixed value; Y represents a regulation coefficient. Here, preferably, Y can represent a row number being charged with a data voltage, but the present invention is not limited. As another embodiment of the present invention, the pixels arranged a matrix can be divided into multiple pixel groups using one row as a unit. Group numbers of the multiple pixel groups are gradually increased along the scanning direction, and each pixel group includes two rows of the pixels, then, Y represents the group number of each pixel group.

In the present embodiment, preferably, the switching devices are NMOS thin-film transistors. Accordingly, when the polarity inversion signal is inverted to a positive polarity from a negative polarity, the gain module 123 set p as 1; if the polarity inversion signal is inverted to a negative polarity from a positive polarity, the gain module 123 set p as 0.

As another embodiment of the present embodiment, the switching devices can also be PMOS thin-film transistors. Accordingly, when the polarity inversion signal is inverted to a positive polarity from a negative polarity, the gain module 123 set p as 0; if the polarity inversion signal is inverted to a negative polarity from a positive polarity, the gain module 123 set p as 1. It should be noted that in the present invention, the switching devices can be other types of thin-film transistors such as CMOS thin-film transistor. Wherein, the condition of amplification can be adjusted according to a design type.

The output module 124 receives the original data voltage or the data voltage after being amplified. The output module 124 outputs the original data voltage or the data voltage after being amplified to the data lines $D_1$ to $D_M$.

Figure 3:
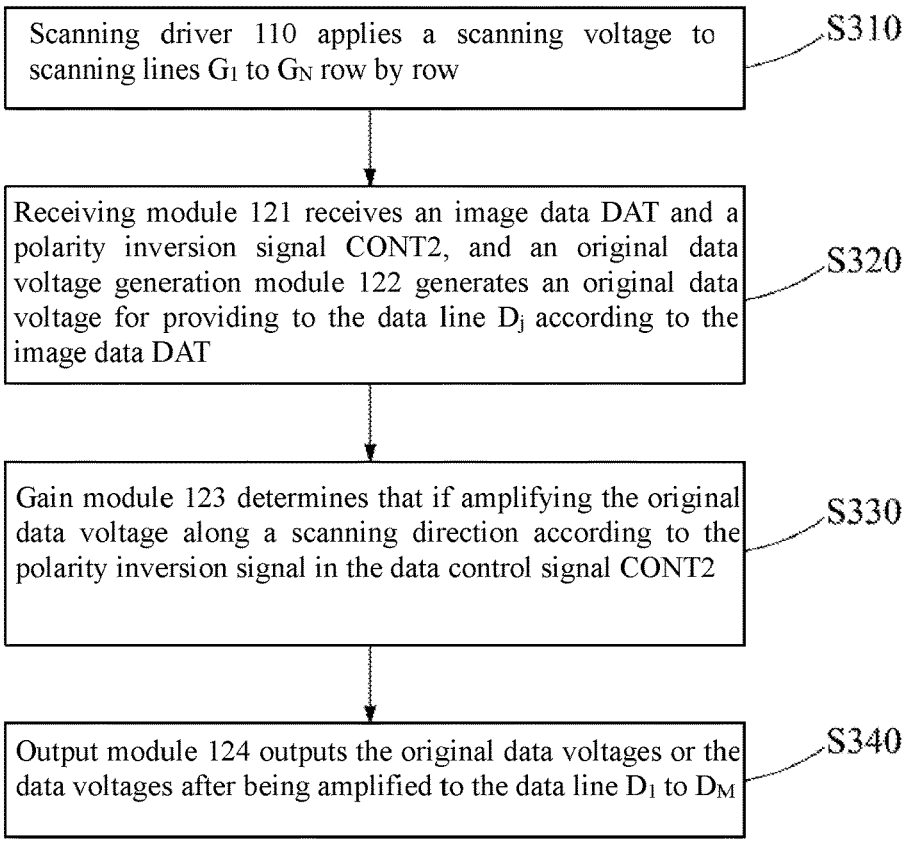
FIG. 3 is a flow chart of a driving method for liquid crystal panel according to an embodiment of the present invention.

FIG. 3 is a flow chart of a driving method for liquid crystal panel according to an embodiment of the present invention.

With reference to FIG. 1 to FIG. 3, the driving method for liquid crystal panel according to an embodiment of the present invention includes: Step S310, a scanning driver 110 responses to the scanning control signal CONT1 and applying a scanning voltage having high voltage level signal to scanning lines $G_1$ to $G_N$ in order to turn on switching devices connected to the scanning lines $G_1$ to $G_N$ row by row so as to apply the scanning voltage to the scanning lines $G_1$ to $G_N$ row by row.

Step S320, a receiving module 121 receives an image data DAT and a polarity inversion signal (included in a data control signal CONT2); an original data voltage generation module 122 selects a grayscale voltage corresponding to the image data DAT from multiple grayscale voltages provided by a grayscale voltage generation device (not shown) according to the image data DAT to convert the image data DAT to an original data voltage for providing to the data line $D_j$ (that is, pixels PX in each column).

Step S330, a gain module 123 determines that if amplifying the original data voltage along a scanning direction according to the polarity inversion signal in the data control signal CONT2.

Specifically, if the polarity inversion signal is inverted to a positive polarity from a negative polarity, the gain module 123 is determined to amplify the original data voltage along the scanning direction, and the data voltage being amplified is transmitted to the output module 124. If the polarity inversion signal is inverted to a positive polarity from a negative polarity, the gain module 123 is determined not to amplify the original data voltage, and transmit the original data voltage to the output module 124.

Preferably, in the step S330, the gain module 123 utilizes the above formula 1 to amplify the original data voltage.

Besides, when the polarity inversion signal is inverted to a positive polarity from a negative polarity, the gain module 123 set p in the above formula 1 as 1; if the polarity inversion signal is inverted to a negative polarity from a positive polarity, the gain module 123 set p in the above formula 1 as 0.

Step S340, an output module 124 outputs the original data voltages or the data voltages after being amplified to the data line $D_1$ to $D_M$.

Besides, the above method of the present invention can be realized by computer codes in a readable record medium in a computer. The person skilled din the art can realize the computer codes through the description of the above method. When the computer codes are executed in the computer, the method of the present invention is realized.

Besides, the devices and modules in the display device of the embodiments of the present invention can be realized as a hardware component. The person skilled in the art can utilize the above devices and modules, and utilize the field programmable gate array (FPGA) or the application specific integrated circuit (ASIC) to realize the devices or modules.

In summary, according to the embodiment of the present invention, when the polarity inversion signal is inverted to a positive polarity from a negative polarity, the data voltages applied on the data line are gradually increased along a scanning direction. Accordingly, when the polarity inversion signal is inverted to a negative polarity from a positive polarity, because the pixel PX which leaks current seriously is charged with a larger amount of charges previously so that the phenomenon of uneven display brightness of the liquid crystal panel can be obviously decreased.

The above content combines the embodiments to describe the present invention, however, the implement of the present invention is not limited. Within the spirit and scope of present invention, the person in this technology field can perform various modifications and variations. The modifications and variations are still covered by the claims in the present invention.

What is claimed is:

1. A driving device for a liquid crystal panel, comprising:

a scanning driver for applying a scanning voltage to pixels arranged as a matrix in a liquid crystal panel row by row; and a data driver for receiving an image data and a polarity inversion signal, obtaining original data voltages to provide to the pixels in each column according to the image data, determining an amplification coefficient for the original data voltages to provide to the pixels in each column along a scanning direction according to the polarity inversion signal, and providing the original data voltages or amplified data voltages to the pixels in each column;

wherein, if the polarity inversion signal is inverted to a positive polarity from a negative polarity, the original data voltages provided to the pixels in each column along the scanning direction are amplified to produce the amplified data voltages;

wherein, the gain module further utilizes a following formula 1 to amplify the original data voltages to provide to the pixels in each column, $$V_0 = Vi \cdot (Y \cdot U + X)^{pn} \quad \text{[formula 1]}$$

wherein, Vi represents an original data voltage, Vo represents a data voltage after being amplified, $(Y \cdot U+X)^{pn}$ represents an amplification coefficient, which is gradually increased along the scanning direction; U, X and n are reference coefficients, and each is a fixed value; Y represents a regulation coefficient; p represents a gain coefficient;

wherein, when the polarity inversion signal is inverted to a positive polarity from a negative polarity, the gain coefficient p is set as 1; when the polarity inversion signal is inverted to a negative polarity from a positive polarity, the gain coefficient p is set as 0.

2. The driving device according to claim 1, wherein, the data driver comprises:

a receiving hardware module for receiving the image data and the polarity inversion signal;

an original data voltage producing hardware module for producing the original data voltages to provide to the pixels in each column according to the image data;

a gain hardware module for determining the amplification coefficient for the original data voltages to provide to the pixels in each column along the scanning direction according to the polarity inversion signal; and an output hardware module for providing the original data voltages or amplified data voltages to the pixels in each column.

3. The driving device according to claim 1, wherein, the pixels arranged as a matrix can be divided into multiple pixel groups, each pixel group includes at least one row of pixels, group numbers of the multiple pixel groups are gradually increased along the scanning direction, and Y represents the group number of each pixel group.

4. A driving method for a liquid crystal panel, comprising:

applying a scanning voltage to pixels arranged as a matrix in a liquid crystal panel row by row;

receiving an image data and a polarity inversion signal, and obtaining original data voltages to provide to pixels in each column according to the image data;

determining an amplification coefficient for the original data voltages to provide to the pixels in each column along a scanning direction according to the polarity inversion signal; and providing the original data voltages or amplified data voltages to the pixels in each column;

wherein, if the polarity inversion signal is inverted to a positive polarity from a negative polarity, amplifying the original data voltages provided to the pixels in each column along the scanning direction to produce the amplified data voltages;

wherein, further utilizing a following formula 1 to amplify the original data voltages to provide to the pixels in each column, $$V_0 = Vi \cdot (Y \cdot U + X)^{pn} \quad \text{[formula 1]}$$

wherein, Vi represents an original data voltage, Vo represents a data voltage after being amplified, $(Y \cdot U+X)^{pn}$ represents an amplification coefficient, which is gradually increased along the scanning direction; U, X and n are reference coefficients, and each is a fixed value; Y represents a regulation coefficient; p represents a gain coefficient;

wherein, when the polarity inversion signal is inverted to a positive polarity from a negative polarity, the gain coefficient p is set as 1; when the polarity inversion signal is inverted to a negative polarity from a positive polarity, the gain coefficient p is set as 0.

5. The driving method according to claim 4, wherein, the pixels arranged as a matrix can be divided into multiple pixel groups, group numbers of the multiple pixel groups are gradually increased along the scanning direction, and Y represents the group number of each pixel group.

* * * * *